United States Patent [19]

Snow

[11] 4,364,824

[45] Dec. 21, 1982

[54] FLOTATION OF PHOSPHATE ORES CONTAINING DOLOMITE

[75] Inventor: Robert E. Snow, Lakeland, Fla.

[73] Assignee: International Minerals & Chemical Corp., Terre Haute, Ind.

[21] Appl. No.: 269,448

[22] Filed: Jun. 2, 1981

[51] Int. Cl.[3] ..... B03D 1/14

[52] U.S. Cl. ..... 209/167; 209/9; 209/12

[58] Field of Search ..... 209/12, 166, 167, 4, 209/9

[56] References Cited

U.S. PATENT DOCUMENTS

| | | | |
|---|---|---|---|
| 2,185,541 | 1/1940 | Cahn | 209/166 X |
| 2,293,640 | 8/1942 | Crago | 209/166 |
| 3,098,817 | 7/1963 | Baarson | 209/166 |
| 3,113,838 | 12/1963 | Perri | 209/166 X |
| 3,246,748 | 4/1966 | Burwell | 209/166 X |
| 3,259,242 | 6/1966 | Snow | 209/166 |
| 3,405,802 | 10/1968 | Preller | 209/166 |
| 3,462,016 | 8/1969 | Bushell | 209/166 |
| 3,462,017 | 8/1969 | Bushell | 209/166 |
| 3,807,556 | 5/1974 | Johnston | 209/166 |
| 4,008,151 | 2/1977 | Swani | 209/167 X |
| 4,144,969 | 3/1979 | Snow | 209/166 |
| 4,189,103 | 2/1980 | Lawver | 209/12 |
| 4,287,053 | 9/1981 | Lehl | 209/167 |

*Primary Examiner*—Norman Yudkoff

*Attorney, Agent, or Firm*—H. J. Barnett

[57] ABSTRACT

A reverse flotation process for removing alkaline earth metal carbonate impurities particularly dolomite and calcite as the cell overflow from a flotation feed reagentized with water, a carbonate collector, a phosphate depressant and a pH regulator to about 20–30% solids and a pH of about 5.5–6.0. The phosphate concentrate is collected as the cell underflow.

The carbonate collectors comprise stable salts of sulfonated linear fatty acids having a straight carbon chain of about eight to twenty-two carbon atoms and a direct sulfur to carbon bond. The sodium salt of sulfonated oleic acid is the preferred carbonate collector. Phosphate depressants include sodium tripolyphosphate.

The flotation feed particle size is preferably such that 90% by weight of the particles pass through a 42 Mesh (Tyler) screen. The effectiveness of the separation improves as the particle size of the flotation feed is decreased.

23 Claims, 1 Drawing Figure

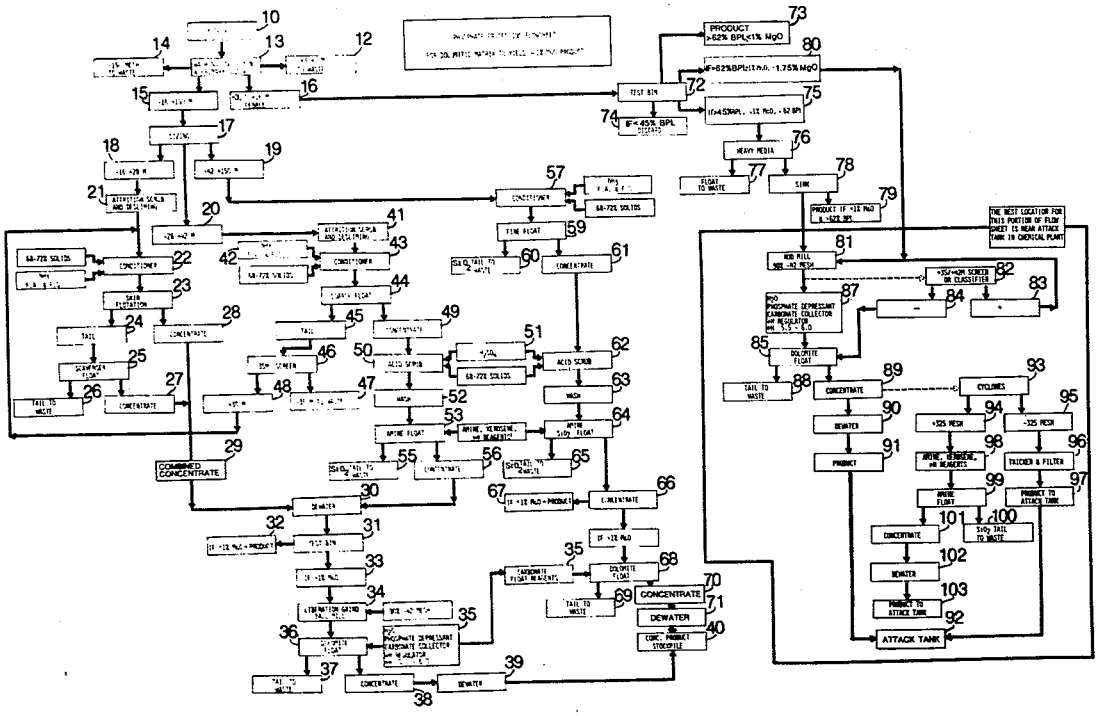

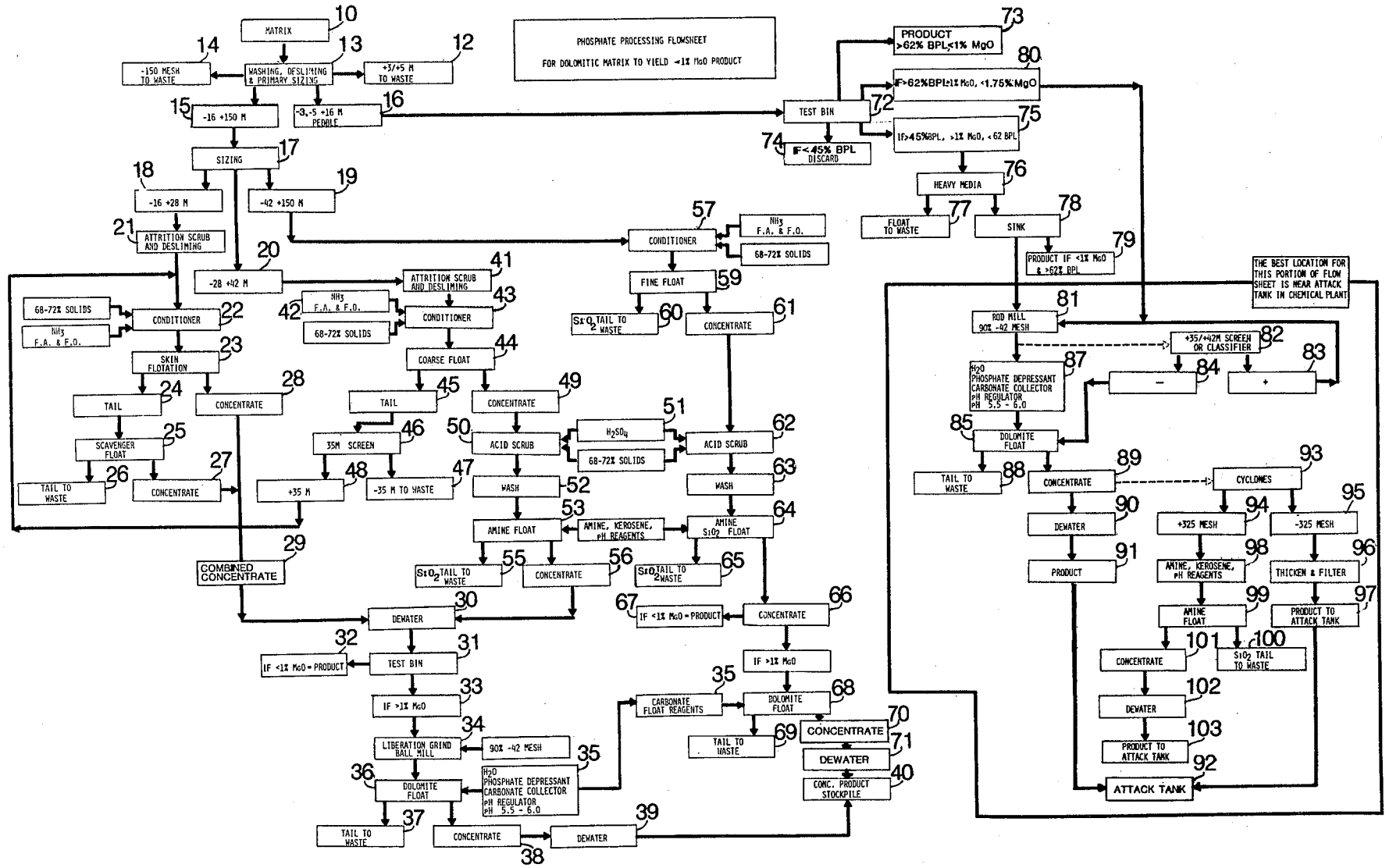
PHOSPHATE PROCESSING FLOWSHEET
FOR DOLOMITIC MATRIX TO YIELD <1% MgO PRODUCT
MATRIX
WASHING, DESLIMING & PRIMARY SIZING
-150 MESH TO WASTE
+3/+5 M TO WASTE
-3.5 +16 M PEBBLE
-16 +150 M
SIZING
-16 +28 M
ATTRITION SCRUB AND DESLIMING
-42 +150 M
-28 +42 M
CONDITIONER
SKIN FLOTATION
TAIL
SCAVENGER FLOAT
TAIL TO WASTE
CONCENTRATE
68-72% SOLIDS
NH3 F.A. & F.O.
ATTRITION SCRUB AND DESLIMING
CONDITIONER
COARSE FLOAT
35M SCREEN
-35 M TO WASTE
+35 M
COMBINED CONCENTRATE
TEST BIN
PRODUCT >62% BPL, <1% MgO
IF>62%BPL, >1% MgO, <1.75% MgO
IF>45%BPL, >1% MgO, <62 BPL
IF<45% BPL DISCARD
HEAVY MEDIA
FLOAT TO WASTE
SINK
PRODUCT IF <1% MgO & >62% BPL
THE BEST LOCATION FOR THIS PORTION OF FLOW SHEET IS NEAR ATTACK TANK IN CHEMICAL PLANT
ROD MILL 90% -42 MESH
+35/+42M SCREEN OR CLASSIFIER
H2O PHOSPHATE DEPRESSANT CARBONATE COLLECTOR pH REGULATOR pH 3.5 - 5.0
DOLOMITE FLOAT
TAIL TO WASTE
CONCENTRATE
DEWATER
PRODUCT
CYCLONES
-325 MESH
+325 MESH
THICKEN & FILTER
PRODUCT TO ATTACK TANK
AMINE, KEROSENE, pH REAGENTS
AMINE FLOAT
SiO2 TAIL TO WASTE
CONCENTRATE
DEWATER
PRODUCT TO ATTACK TANK
ATTACK TANK
CONDITIONER
FINE FLOAT
SiO2 TAIL TO WASTE
ACID SCRUB
WASH
AMINE FLOAT
H2SO4
AMINE, KEROSENE, pH REAGENTS
IF <1% MgO = PRODUCT
IF >1% MgO
DOLOMITE FLOAT
CARBONATE FLOAT REAGENTS
CONCENTRATE
DEWATER
CONC. PRODUCT STOCKPILE
IF <1% MgO = PRODUCT
IF >1% MgO
LIBERATION GRIND BALL MILL
90% -42 MESH
H2O PHOSPHATE DEPRESSANT CARBONATE COLLECTOR pH REGULATOR pH 3.5 - 5.0

FLOTATION OF PHOSPHATE ORES CONTAINING DOLOMITE

BACKGROUND OF THE INVENTION

Phosphate ores occur in important deposits in various parts of the world, including central Florida. Each deposit has characteristic impurities which must first be removed to increase the phosphate content of the material so that it can be used in fertilizers to enrich farmlands and thereby increase crop yields. The phosphate content of fertilizers is generally expressed as "BPL" content [bone phosphate of lime, or $Ca_3(PO_4)_2$].

The phosphate ore deposits found in central Florida generally contain siliceous mineral (quartz) impurities, and the lower zones of some of these deposits also contain carbonate mineral impurities including dolomite $[Ca,Mg]CO_3$. Such phosphate ores have been improved in phosphate content by various "beneficiating" processes to remove a major portion of the impurities, and thereby increase the phosphorus content [expressed in terms of phosphorus pentoxide ($P_2O_5$) by the chemist].

Froth flotation and skin flotation beneficiation are conventionally used to remove siliceous gangue materials from the phosphate-containing ores. In such a process, the ore materials are classified into various particle sizes. The coarser fractions may be suitable for direct sale, or may be further beneficiated by sizing and by froth and skin flotation techniques. The very fine materials, which primarily contain clay slimes and clay-sized particles are usually discarded. The intermediate fraction, which typically has a particle size range from about 0.10 mm up to about 1.0 mm represents the bulk of the material which has the greatest need for beneficiation.

U.S. Pat. No. 2,293,640 issued to A. Crago describes a "double float" froth flotation which is commercially used for beneficiating such fractions of phosphate ores in which siliceous minerals (quartz) are the predominant gangue. The intermediate size fraction is conditioned with fatty acid reagents and the phosphate mineral is floated to separate it from the bulk of the silica tail impurities. The float portion is deoiled with sulfuric acid, rinsed, and refloated with amine reagents to float away the remaining silica tail impurities.

Removal of dolomite and similar carbonate mineral impurities from phosphate ores such as apatite, fluorapatite and francolite by the above double flotation method has generally been ineffective because the flotation characteristics of the carbonate minerals (dolomite) are very similar to those of these phosphate-containing minerals.

As used herein, "francolite" is intended to refer to sedimentary apatites, found in phosphate-containing mineral ores in Florida, including carbonate fluorapatite. These ores usually carry quartz (silica) and some contain dolomite $[Ca,Mg]CO_3$ impurities. In the Florida phosphate deposits, francolite with dolomite impurities is typically found in the lower zone of the Hawthorn formation in which the carbonates of calcium and magnesium have not been leached out.

Phosphate ores containing primarily quartz impurities with lesser amounts of dolomite impurities are often found in an upper zone in a phosphate deposit above the lower zone. In the past, the practice has been to recover only the upper zone phosphate ores and leave the lower zone ores because the methods available to remove dolomite added too much cost to the product, and the added recovery was not considered worth the effort. More recently, however, the market value of phosphate fertilizers has increased sufficiently to warrant the added recovery costs of mining the lower zone deposits simultaneously with the upper zone phosphate ore deposits.

Methods for beneficiating phosphate ores containing carbonate and siliceous gangue materials are described in U.S. Pat. Nos. 3,259,242; 3,462,016; 3,462,017; 3,807,556; 4,144,969 and 4,189,103. Each of these patents deals with the difficulties associated with the separation of carbonate mineral impurities such as dolomite from the phosphate ore.

U.S. Pat. Nos. 4,144,969 and 4,189,103 which are assigned to a common assignee herewith, describe a phosphate ore beneficiating process in which the deslimed ore is first subjected to a "double float" froth flotation as described in U.S. Pat. No. 2,293,640 to remove siliceous gangue. The float product containing apatite with dolomite impurities is then conditioned at about 70% solids with an apatite-collecting cationic reagent and a liquid hydrocarbon, and then subjected to a froth flotation. Most of the apatite is recovered in the froth concentrate and the alkaline earth metal carbonate impurities (dolomite) are rejected in the underflow tailings.

Dolomite is removed as a float or froth concentrate from phosphate-containing ores in the processes described in U.S. Pat. Nos. 3,462,016; 3,462,017 and 3,807,556. Siliceous gangue is removed in the first stage of a two-stage anionic flotation. The siliceous gangue is the underflow, while the phosphate minerals with carbonate impurities are separated as the "float" in the first stage. The phosphate minerals are then selectively depressed for removal as an underflow concentrate, and the carbonate impurities are floated in the second stage. Fatty acid collector reagents such as oleic acid, stearic acid, and other carboxylic acids including tall oils are used for both the first and second stage anionic flotation. In the second stage, the carbonate particles are floated, and the apatite particles (phosphate) sink.

The Johnston U.S. Pat. No. 3,807,556 adds a soluble sulphate salt in the interstage conditioning of the above processes to reduce the loss of soluble phosphate in the second stage flotation. It is believed that the Johnston patent tacitly recognizes the sensitivity of the fatty acid collector reagents in the above flotation to variations of pH frequently experienced in actual plant operations. See Johnston U.S. Pat. No. 3,807,556, column 3, lines 3–16.

The general concept of carbonate flotation, however, is very desirable to obtain a greater yield of phosphate from phosphate ores containing both apatite and carbonate. In order to have a commercially practical process for carbonate flotation, the problems described above in the Johnston patent must first be solved.

A process for more effective carbonate separation has application to certain central Florida deposits and the western phosphates found in Idaho, Montana, Utah and Wyoming. Applicant has developed such a process which has particular utility for the dolomite-containing phosphate ores of central Florida.

The copending application of James E. Lawver, Robert E. Snow and Walter O. McClintock, filed on even date herewith, is directed to an improved process for beneficiating phosphate ores containing dolomite which includes the subject flotation method for removing dolomite [Ca,Mg]$CO_3$ from the phosphate concentrates obtained from phosphorite/dolomite ores by a reverse flotation with an anionic flotation agent comprising a sulfonated fatty acid.

As used herein, the term "mesh" refers to standard Tyler mesh, and if an ore fraction is said to have a particle size smaller than a certain mesh, such statement means that substantially all of the fraction will pass through a screen having that Tyler mesh size, and likewise, if an ore fraction is said to have a particle size greater than a certain mesh, then substantially none of the material will pass through a screen having that Tyler mesh size. As used herein, the symbol "M" also refers to Tyler mesh size.

SUMMARY OF THE INVENTION

The subject invention is directed to an improved reverse flotation process for removing alkaline earth metal carbonate impurities, particularly dolomite [Ca,Mg]$CO_3$ and calcite, from a phosphate concentrate obtained from phosphorite/dolomite ores, including the steps of (a) reagentizing the phosphate concentrate with a phosphate depressant, a carbonate collector and a pH regulator (to pH 5.5–6.0), and adjusting the solids to about 20–30% with water to make a flotation feed; and (b) subjecting the flotation feed to flotation to cause less dense alkaline earth metal carbonate mineral impurities to float, and the phosphate-containing materials to sink to thereby remove said alkaline earth carbonate mineral impurities as an overflow tail to waste, and to collect as an underflow a phosphate concentrate containing substantially less alkaline earth metal carbonate impurities, said carbonate collector being selected from the group consisting essentially of sulfonated fatty acids having a linear carbon chain of 8–22 carbon atoms and in which the sulfur moiety is attached directly to a carbon atom in the fatty acid.

DETAILED DESCRIPTION OF THE INVENTION

Phosphate ores which are beneficiated by the method of the subject invention are found in sedimentary deposits in central Florida. Typically, the overburden is first removed, and the phosphate-rich ores are collected by dragline mining techniques. These ores are generally referred to as apatite and carbonate-fluorapatite-containing ores. A more specific description for the phosphate values in these ores is "francolite". The invention is particularly adapted to separating alkaline earth metal carbonate impurities, particularly dolomite [Ca,Mg]$CO_3$, from francolite.

The invention is further illustrated by the drawings wherein the FIGURE is a flow diagram of a preferred embodiment for overall processing of phosphorite/dolomite ores, and includes the reverse flotation process of the subject invention at the places indicated. The invention is not limited to the preferred embodiment, but is encompassed by the broad scope of the appended claims.

Ore matrix 10 is first washed, deslimed and sized by conventional techniques at 11. Early removal of the clay slimes is desirable to avoid excessive consumption of flotation reagents by the slimes. The amount and quality of phosphate found in the typical clay slimes is not sufficient to warrant recovery.

The deslimed ore matrix usually contains large rocks or agglomerates ("mud-balls") which must be reduced in size or removed from the ore matrix 10. The slurried ore matrix is washed and sized as shown to remove such larger particles 12. Hammermills, impactors or similar devices are used to reduce the size of those larger particles which are not easily reduced in size by log washers used in the washing and sizing operation 11.

The pebble portion of the ore matrix 10 which is about +16 mesh is collected, and the larger particles 12 which are about +3/+5 mesh are generally discarded. The collected −16 mesh "debris" is then deslimed to produce a deslimed debris 13 having a particle size smaller than about 16 mesh and larger than about 150 mesh. The −150 mesh material 14 is sent to waste.

The deslimed debris 13 is then split into a first fraction 15 which is −16 to +150 mesh and a pebble fraction 16 (−3/−5+16 mesh). The first fraction 15 is further sized as at 17 into a skin float feed fraction 18 (−16+28 M), a fine feed fraction 19 (−42+150 M) and a coarse feed fraction 20 (−28+42 M). The skin float feed fraction 18 is then subjected to attrition scrubbing and desliming at 21, followed by reagentizing in a conditioner 22, where the slurry is dewatered to 68–72% solids. Ammonia, fatty acid and fuel oil are added to the skin flotation feed fraction 18 in the conditioner 22, and the conditioned skin flotation feed fraction 18 is subjected to a conventional skin flotation 23 employing Humphrey spirals available from Jensco, Inc., Eaton Park, Fla. In the conventional skin flotation, the conditioned phosphate skin flotation feed fraction 18 is skin floated in the spirals, and tail 24 drops out of each flight. Other equipment may be used instead of Humphrey spirals to accomplish the above skin flotation. Such equipment is well-known for this use, and includes moving belts, washing tables and combinations of these. Tail 24 from the skin flotation 23 is subjected to a scavenger float 25. Tail 26 from the scavenger float 25 is discarded. Concentrate 27 from the scavenger float 25 is blended with concentrate 28 from the skin flotation 23 to form a combined concentrate 29.

The combined concentrate 29 is then dewatered at 30, and collected to test bin 31. If the combined concentrate 29 contains less than 1% by weight MgO, it can be sold as product 32 without further processing.

If the dewatered combined concentrate 29 contains more than 1% by weight MgO as at 33, it is subjected to "liberation" grinding at 34 in ball mills or rod mills to release the francolite from the concentrate 29. The concentrate 29 is ground until at least 90% of the ore is about −42 mesh, or less than about 0.356 mm in particle size.

Water and reagents are added at 35 to the dewatered combined concentrate 29 at dolomite float cell 36. Sufficient water is added to bring the slurry to about 15–25% solids. Included in the reagents added at this point are a phosphate depressant, a carbonate collector and a pH regulator to adjust the pH to about 4.5–6.9, or more preferably, about 5.5–6.0. Sulfuric acid ($H_2SO_4$) is presently used as the pH regulator, but other pH regulators, including phosphoric acid, and acidic waters from the other processes may be used, including pond waters which contain fluosilicic acid. A conventional phosphate depressant such as sodium tripolyphosphate is added to depress the phosphate in the slurried concentrate 29, and to inhibit the attachment of the flotation agent to the phosphate particles.

A water soluble sodium salt of a sulfonated oleic acid is added at this point as an anionic flotation agent for dolomite. The anionic flotation agent attaches to the dolomite impurities and they are floated away to waste 37 as the flotation cell overflow to separate the dolomite from phosphate concentrate 38, which is the cell underflow from the dolomite float 36. The phosphate concentrate 38 is then dewatered at 39 and delivered to concentrate product stockpile at 40.

The coarse feed fraction 20 is subjected to attrition scrubbing and desliming at 41 and then reagentized with reagents 42 in the conditioner 43. The slurry is adjusted by dewatering or adding water as necessary to 68–72% solids, and ammonia, fatty acid and fuel oil are added, and the conditioned coarse feed fraction 20 is then subjected to a coarse float at 44.

Cell underflow tail 45 from the coarse float 44 is sized at 35 mesh, as by screen 46, and the −35 M "unders" 47 are sent to waste. The +35 M "overs" 48 are sent back to the conditioner 22 and combined with the first fraction 15 (−16+150 M) to be conditioned and subjected to the skin flotation 23.

Concentrate 49 from the coarse float 44 is adjusted to 68–72% solids and acid scrubbed at 50 with sulfuric acid 51. Concentrate 49 is then washed at 52 and subjected to a conventional amine float 53 with the usual amine, kerosene and pH reagents 54.

The amine float 53 produces a cell overflow silica tail 55 which goes to waste, and a cell underflow phosphate concentrate 56. The phosphate concentrate 56 is dewatered at 30 and tested at 31. If it contains more than about 1% MgO, it is mixed with the combined concentrate 29 from the skin flotatiion 23 and the scavenger float 25, treated as described above, and with those fractions, it is subjected to the dolomite float at 36 as described above to remove alkaline earth metal carbonate impurities (dolomite).

The fine feed fraction 19 (−42+150 M) is adjusted to 68–72% solids and reagentized at conditioner 57 with reagents 58, which are the same as reagents 42 to prepare the fine feed fraction 19 for fine float 59. The conditioned fine feed fraction 19 is then subjected to fine float 59. Silica tail 60 is sent to waste. The float concentrate 61 is sent to acid scrub 62, where it is scrubbed with sulfuric acid 51, and the solids level is again adjusted to 68–72%. The scrubbed float concentrate 61 is then washed at 63, reagentized at 54, and then subjected to an amine float 64 to remove the cell overflow silica tail 65 to waste.

Cell underflow phosphate concentrate 66 is tested, and if it contains less than 1% MgO, it is collected as product 67. If the cell underflow phosphate concentrate 66 contains more than 1% MgO, it is subjected to a dolomite float 68 as described above at dolomite float 36 using all the same conditioning reagents 35 including the sulfonated oleic acid anionic flotation agent as described above. The overflow tails 69 which comprise primarily the dolomite impurities, are sent to waste. The cell underflow phosphate concentrate 70 is dewatered at 71, and sent to the concentrated product stockpile 40.

The pebble fraction 16 (−3,−5+16 M) is sent to test bin 72. If pebble fraction 16 contains more than 62% BPL (bone phosphate of lime) and less than 1% MgO, it is collected as product 73. If pebble fraction 16 contains less than about 45–50% BPL, it is sent to discard 74. If the pebble fraction 16 contains more than about 45–50% BPL, but below 62% BPL, and more than 1% MgO as at 75, it is subjected to heavy media separation 76. Float 77 is sent to waste, and sink product 78 is tested. If sink product 78 contains less than 1% MgO and more than 62% BPL, it is collected as product 79. If sink product 78 contains more than 1% MgO, it is taken to rod mill 81 and ground to at least 90% −42 mesh particle size.

If the pebble fraction 16 (−3,−5+16 M) has greater than 62% BPL, greater than 1% MgO, but less than 2.0% MgO as at 80, it is sent directly to the rod mill 81 where it is ground to at least 90% −42 mesh particle size. The rod mill 81 is optionally provided with a screen or classifier 82 which can be used for sizing particles at 35 or 42 M. The oversize particles 83 are recycled back to the rod mill 81. The undersize particles 84 which do pass through the screen are sent on to dolomite float 85. The same reagents 86 as described above are added here to condition the sized mill discharge 87 for the dolomite float 85.

The cell overflow tails 88 from the dolomite float 85 containing the dolomite impurities are sent to waste, while the cell underflow phosphate concentrate 89 is dewatered at 90 to become product 91. Product 91 can be sent to attack tank storage bin 92 if it is going to be used to make wet process phosphoric acid.

If the condition of the cell underflow phosphate concentrate 89 requires it, it can be subjected to cyclone separation, as at 93 to separate a +325 mesh fraction 94 and a −325 mesh fraction 95. The −325 mesh fraction 95 is thickened and filtered as at 96, and the resulting product 97 is sent to the attack tank 92.

The +325 mesh fraction 94 from the cyclone separation 93 is reagentized with amine, kerosene and pH reagents 98 as described above, and is then subjected to a conventional amine float 99 as described above to remove silica tail 100 to waste as the cell overflow. Cell underflow phosphate concentrate 101 is dewatered at 102 and the dewatered product 103 is sent to the attack tank 92.

There are many variations of the above process which will adapt the process for most efficient use for recovery of the phosphate values from a particular phosphate ore deposit. Such variations will be readily apparent to the man skilled in the art. The most significant feature of the subject process is the "reverse" flotation of dolomite, in which the dolomite is floated away and the phosphate-rich apatite minerals are the cell underflow product. The effectiveness of the reverse flotation of dolomite depends to a large extent on the use of a sulfonated fatty acid anionic flotation agent which is stable under the acid pH conditions experienced in phosphate ore beneficiation. A particularly effective sulfonated fatty acid which is used in the process of the subject invention is the sodium salt of sulfonated oleic acid in an aqueous solution. A typical analysis for this composition is:

| | |
|---|---|
| Active ingredients | 41.0% |
| Fatty acid | 7.0% |
| Inorganic sulfates | 2.6% |
| Water | 45.0% |

The active composition is a true sulfonate (C—S linkage) making it a stable compound. Based on the description in U.S. Pat. No. 2,743,288, the structural formula is believed to be:

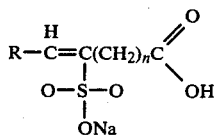

R = $CH_3[CH_2]_7$
n = 5–8

As stated in the above patent, the carbon chain length may vary to some extent. A satisfactory compound is available from Cities Service Company, Industrial Chemicals Division, P.O. Box 50360, Atlanta, Ga. 30302; and is sold under the trademark SUL-FON-ATE OA-5. Although the subject compound is a sulfonated oleic acid, other sulfonated linear fatty acids ($C_{12}$–$C_{22}$), both saturated and unsaturated, and their stable salts, can also be used in combination with conventional phosphate depressants, and will function effectively as anionic flotation agents which selectively attach to alkaline earth metal carbonate impurities in phosphate-containing ores to float away alkaline earth metal carbonate impurities.

Additional sulfonated linear fatty acids have been used successfully in the process of the subject invention as anionic flotation agents to float away dolomite from francolite (phosphorite ores). Sodium oleyl sulfonate, sold as SUL-FON-ATE OA-5 by Cities Service Company, was evaluated as the best, or preferred anionic flotation agent to selectively attach to the dolomite particles of a mixed phosphorite ore containing alkaline earth metal carbonate impurities such as dolomite $[Ca,Mg]CO_3$, and calcite, $CaCO_3$.

Another preferred compound used in the subject flotation process is a tall oil based sodium oleyl sulfonate sold by Cities Service Company, under the trademark OA-5U. OA-5U is listed as 38% active materials.

Westvaco, Inc. has two products which are useful in the reverse floatation method of the invention. They are available from the Custom Chemicals Division of Westvaco, Mulberry, Fla. and are sold under the trademarks C.C. Sulfonate 502 and C.C. Sulfonate 535. They are believed to be sulfonated tall oils. C.C. Sulfonate 502 is listed as 49% active materials by the manufacturer.

The true sulfonates have a strong C—S linkage, and are quite stable even in acid solutions. Acid stability, high solubility, effectiveness even under alkaline conditions and improved activity make these sulfonated linear fatty acids, particularly sodium oleyl sulfonate, ideally suited for use as anionic flotation agents for floating dolomite away from mixed phosphorite ores. The compound is effective at much lower levels than those used previously for reverse flotation of dolomite.

Prior flotation agents include conventional fatty acid collectors, such as oleic acid, stearic acid, or other carboxylic acids including tall oils, and these have been used in conventional first stage flotation of phosphorite minerals and dolomite from silica, followed by selective deactivation of the phosphorite minerals in the second stage of the flotation with phosphate ions produced by alkali phosphates such as ammonium phosphate, sodium phosphate, potassium phosphate and phosphoric acid. In one case, alkyl arylsulphonate was added after the first float as an additional conditioning reagent. The above prior art process was further modified by the addition of a soluble sulfate salt [$Na_2SO_4$ or $(NH_4)_2SO_4$] to decrease phosphate losses in the second stage flotation (See U.S. Pat. No. 3,807,556, column 2, lines 28–61).

Another related group of collectors for ore flotation are described in U.S. Pat. No. 3,779,380. See, particularly, column 1 and column 2 of that patent. It is contemplated that the collectors described therein can be sulfonated, and the alkali metal sulfonate salts thereof obtained for use as carbonate collectors of the subject invention. Such compounds include the sodium and potassium salts of sulfonated lauroleic, myristoleic, palmitoleic, oleic, erucic, linoleic, linolenic and eleostearic acid. As pointed out in the subject patent, the commercially available fatty acid fractions obtained from the fractional distillation of tall oil may contain a combination of more than one fatty acid having different chain lengths. Combinations of the metal sulfonates of the various fatty acids are also contemplated for use as carbonate collectors, provided they are water soluble, acid stable and do not contain excess impurities, such as rosins or unsaponifiables, to interfere with their function.

Another important advantage of the preferred anionic flotation agents (carbonate collectors) of the subject invention is that water hardness has little effect on their wetting properties. The wetting time of sodium oleyl sulfonate actually decreases by one half as the hardness increases from 100 ppm to 1000 ppm. The process water typically available for phosphorite ore beneficiation has high hardness levels, and the resistance of the salts of sulfonated fatty acid type carbonate collector to precipitation by calcium and magnesium ions in the flotation slurry enables moderate carbonate collector levels to be highly effective in the subject flotation process. A low foaming characteristic is also an important advantage of sulfonated linear fatty acids over conventional fatty acid and tall oil collectors previously used in dolomite flotation.

The water soluble salts of sulfonated elaidic, stearic, palmitic and lauric acids having the required acid stability and low foaming characteristics are also contemplated for use as carbonate collectors in the subject flotation method. At the present time, the sodium salt of sulfonated oleic acid (also described as sodium oleyl sulfonate) is preferred for reasons of availability, performance and cost. The amount of the particular alkali metal salt of a sulfonated linear fatty acid used in the dolomite flotation may vary from about 1.5 to 2.75 lbs/ton of feed solids depending on the percent active in the aqueous reagent, the amount of dolomite in the flotation feed and its general effectiveness in floating the carbonate impurities. In typical flotations, in which typical lower zone phosphorite/dolomite ores comprise the flotation feed, about 2.5 lbs/ton of feed solids has been used effectively to collect and float away the dolomite from the francolite (phosphate) ores.

Alkyl benzyl sulfonate has been tried as an anionic flotation agent for dolomite in the method of the subject invention, but cannot be considered in the same superior category with the subject sulfonated linear fatty acids. It is believed important that the fatty acid portion of the flotation agent molecule have a linear carbon chain, and that one of the carbons in the linear carbon chain be attached directly to the sulfur of the sulfonate group to provide the required stability in a medium having a widely fluctuating pH (usually acid).

The presently preferred depressant for the phosphate values in the flotation feed for the reverse flotation of dolomite from phosphorite ores is sodium tripolyphosphate. Other conventional depressants for phosphate can be used, including sodium hexametaphosphate, sodium pyrophosphate, fluosilicic acid (without $H_2SO_4$) and orthophosphoric acid (clarified phosphoric acid).

Sulfonated linear fatty acids have been used before in the phosphate chemical industry, but they have been used only as defoaming agents, not as an anionic flotation agent for floating alkaline earth metal carbonate impurities such as dolomite away from apatites such as francolite, carbonate fluorapatite and other phosphate-containing ores such as collophane.

U.S. Pat. No. 2,743,288 issued Apr. 24, 1956, describes a method for making sulfonated carboxylic acids. See column 3, lines 2–18 and particularly, column 3, lines 71–75 and column 4, lines 1–75 of U.S. Pat. No. 2,743,288. As pointed out in the subject patent, in the true sulfonated carboxylic acid having a carbon-sulfur bond the sulfonic acid group exhibits unusually high resistance to hydrolysis and heat.

An important feature of this invention is the surprising superior performance of the water soluble salts of sulfonated, long chain carboxylic acids as anionic flotation agents in the reverse flotation of dolomite from phosphorite ores as compared to conventional, non-sulfonated fatty acid and tall oil anionic flotation agents disclosed in the prior art. Conventional anionic flotation agents are not effective under the acid conditions maintained in the subject flotation, because they react with the calcium and magnesium in the process water to form insoluble compounds which do not function as carbonate collectors.

The following examples illustrate the operation of the process of the subject invention to upgrade the value of phosphorite ores. Particular phosphorite ore samples are used in each example to demonstrate the improvements obtained by the combination of process steps and the novel dolomite flotation.

EXAMPLE 1

A phosphate ore matrix mined from a central Florida ore deposit was beneficiated by the method of the subject invention. Conventional washing, desliming and primary sizing steps were performed on the ore matrix to obtain a pebble fraction of −3+16 M particle size, which was then subjected to rodmilling to prepare it for a dolomite flotation as described herein. The pebble portion of this ore was ground in the rod mill until all the sample passed through 35 M (Tyler) screen, and a wet-dry screen analysis after rodmilling as set forth below.

| | Wet-Dry Screen Analysis Sample 1 | | | | | |
|---|---|---|---|---|---|---|
| Size, Tyler Mesh | Wt., Grams | % Wt. | Cum. Wt. | % BPL | % MgO | % Dist. MgO |
| +35 | 2.2 | 1.1 | 1.1 | | | |
| −35 + 48 | 38.7 | 19.3 | 20.4 | | | |
| −48 + 65 | 36.8 | 18.4 | 38.8 | | | |
| −65 + 100 | 29.7 | 14.8 | 53.6 | (62.69)* | (0.95)* | 46.3 |
| −100 + 150 | 19.2 | 9.6 | 63.2 | | | |
| −150 + 200 | 14.8 | 7.4 | 70.6 | | | |
| −200 | 59.0 | 29.4 | 100.0 | 61.44 | 2.65 | 53.7 |
| Composite Feed | 200.4 | 100.0 | | 62.32 | 1.45 | 100.0 |

*Numbers in parenthesis are calculated.

The sized discharge from the rod mill was then slurried to about 15–25% solids with water, and the pH of the slurry was adjusted to 5.6–6.0 with sulfuric acid. Sodium tripolyphosphate was added at a ratio of about 2 lbs/ton of ground ore. Philflo brand oil from Phillips Petroleum Company, Bartlesville, Okla., was also added, at a ratio of about 2.5 lbs/ton of ground ore. The Philflo oil is added to extend the effectiveness of the carbonate collector. It is a special oil developed for controlling froth in the flotation. Other froth modifiers could also be used, such as kerosene, mineral oil, diesel oil and #5 fuel oil. A sodium salt of sulfonated oleic acid, SUL-FON-ATE OA-5 from Cities Service Company, Industrial Chemicals Division, Atlanta, Ga., was added as the carbonate collector at a ratio of 2.5 lbs/ton of ground ore. The reagentized slurry was then subjected to flotation in a conventional float cell.

As previously described, the sodium salt of sulfonated oleic acid is a carbonate collector, and acts as an anionic flotation agent attaching primarily to the dolomite impurities which are floated away as the dolomite tail in the cell overflow. Most of the phosphate-containing portion of the flotation feed is depressed by the sodium tripolyphosphate, which inhibits the attachment of the sodium salt of sulfonated oleic acid to the phosphate particles. The phosphate concentrate leaves the flotation cell as the cell underflow.

The cell underflow phosphate concentrate was then sized at 325 M (Tyler). The −325 M fine phosphate concentrate was collected as product. The +325 M phosphate concentrate contained a higher percentage of insolubles (about 10% by weight) so it was subjected to a conventional amine flotation to remove silica insolubles.

The rinsed and dewatered +325 M phosphate concentrate was adjusted to approximately 20% solids with water. Custamine 3010 brand of aliphatic amine condensate from Custom Chemicals Division, Westvaco, Inc., Mulberry, Fla., was added at a ratio of about 0.75 lbs/ton of phosphate concentrate, along with kerosene at a ratio of about 0.1 lbs/ton of phosphate concentrate. The resultant pH of the slurry was about 7.1–7.2, and the reagentized slurry was separated by flotation.

The amine flotation overflow silica tail was sent to waste, and the underflow phosphate concentrate was collected and dewatered and combined with the previously collected −325 phosphate concentrate to form a phosphate concentrate product having increased phosphate values, and significantly decreased alkaline earth metal carbonate (dolomite) impurities.

The material balances reported in Table I show the yields and product distributions obtained at the various stages of the process. "% BPL" is the percent phosphate calculated as bone phosphate of lime. The concentration of MgO and CaO indicate the amount of dolomite and calcite in that fraction. "Insolubles" are primarily silica. To obtain the ratios of CaO, MgO and I&A ($Fe_2O_3$ and $Al_2O_3$) to $P_2O_5$, the "BPL" values given are divided by 2.18 to obtain the $P_2O_5$ values. The reference numerals in the table refer to the flow diagram shown in the FIGURE of the drawings, and refer to the step of the process from which the ore fraction was obtained.

TABLE I

Processing Material Balance

| % Wt. | Ref. | Fraction | % BPL | % Insol | % $Fe_2O_3$ | % $Al_2O_3$ | % CaO | % MgO | CaO/ $P_2O_5$ | MgO/ $P_2O_5$ | I&A/ $P_2O_5$ | % Distribution BPL | % Distribution MgO | I&A + MgO/ $P_2O_5$ |
|---|---|---|---|---|---|---|---|---|---|---|---|---|---|---|
| 100 | 16, 78, 84 | −3 + 16M Pebble Rodmill −35M | 62.32 | 9.25 | 0.82 | 0.90 | 44.39 | 1.44 | 1.556 | 0.050 | 0.060 | 100 | 100 | 0.110 |
| Dolomite Flotation | | | | | | | | | | | | | | |
| 17 | 85, 88 | Cell Overflow Dolomite Tail | 50.94 | 4.89 | 0.99 | 0.92 | 42.69 | 5.37 | 1.831 | 0.230 | 0.082 | 13.90 | 63.99 | 0.312 |
| 83 | 85, 89 | Cell Underflow Phosphate Conc | 64.65 | 10.14 | 0.78 | 0.89 | 44.74 | 0.63 | 1.512 | 0.021 | 0.056 | 86.10 | 36.01 | 0.077 |
| Sizing at 325M | | | | | | | | | | | | | | |
| 8.3 | 93, 95, 97 | −325M Phos Conc | 67.73 | 4.79 | 1.07 | 1.27 | 46.53 | 0.79 | 1.501 | 0.025 | 0.075 | 9.02 | 4.37 | 0.100 |
| 74.7 | 93, 94 | +325M Phos Conc | 64.31 | 10.73 | 0.75 | 0.85 | 44.54 | 0.61 | 1.513 | 0.021 | 0.054 | 77.09 | 31.64 | 0.075 |
| Silica Flotation | | | | | | | | | | | | | | |
| 64.90 | 98, 99, 101 | Cell Underflow Phosphate Conc | 71.09 | 1.79 | 0.82 | 0.94 | 49.18 | 0.67 | 1.512 | 0.021 | 0.054 | 74.03 | 30.20 | 0.075 |
| 9.8 | 98, 99, 100 | Cell Overflow Silica Tail | 19.41 | 69.97 | 0.32 | 0.29 | 13.78 | 0.21 | 1.551 | 0.024 | 0.069 | 3.05 | 1.43 | 0.093 |
| 73.2 | 97, 100 | Combined −325M Phos Conc Plus Cell Underflow Phos Conc | 70.71 | 2.13 | 0.85 | 0.98 | 48.88 | 0.68 | 1.511 | 0.021 | 0.057 | 83.05 | 34.57 | 0.078 |

The above processing material balance shows the significant positive effect in upgrading the phosphate ore matrix obtained by the combined steps of grinding, dolomite flotation using a sulfonated fatty acid salt, further sizing and a conventional amine flotation. In this example, the percent bone phosphate of lime was increased from 62.32% up to 71.09%. The percent dolomite (measured as MgO) decreased from 1.44% to 0.67%. This decrease is most important, because MgO levels higher than about 1% substantially decrease the marketability of the refined phosphate product. The percentage bone phosphate of lime (BPL) distribution shows that 83.05% of the phosphate values were recovered.

EXAMPLE 2

All of the steps of Example 1 were repeated on another pebble sample of a phosphorite ore from a central Florida ore deposit. After grinding in a rod mill until substantially all of the sample passed through a 48 mesh (Tyler) screen, the pebble sample gave the following wet-dry screen analysis.

Wet-Dry Screen Analysis
Sample 2

| Size, Tyler Mesh | Wt., Grams | % Wt. | Cum. % Wt. | % BPL | % MgO | % Dist. MgO |
|---|---|---|---|---|---|---|
| +35 | | | | | | |
| −35 + 48 | .5 | .2 | 0.2 | | | |
| −48 + 65 | 5.0 | 2.4 | 2.6 | | | |
| −65 + 100 | 29.1 | 14.0 | 16.6 | (61.90)* | (1.45)* | 18.0 |
| −100 + 150 | 34.8 | 16.7 | 33.3 | | | |
| −150 + 200 | 27.0 | 12.9 | 46.2 | | | |
| −200 | 112.1 | 53.8 | 100.0 | 50.30 | 5.67 | 82.0 |
| Composite Feed | 208.5 | 100.0 | | 55.66 | 3.72 | 100.0 |

*Parentheses indicate calculated values.

The processing material balance for sample 2 is set forth in Table II.

TABLE II

Processing Material Balance

| % Wt. | Ref. | Fraction | % BPL | % Insol | % $Fe_2O_3$ | % $Al_2O_3$ | % CaO | % MgO | CaO/ $P_2O_5$ | MgO/ $P_2O_5$ | I&A/ $P_2O_5$ | % Distribution BPL | % Distribution MgO | I&A + MgO/$P_2O_5$ |
|---|---|---|---|---|---|---|---|---|---|---|---|---|---|---|
| 100 | 16, 78, 84 | −3 + 16M Pebble Rod mill −48M | 55.66 | 7.52 | 1.34 | 0.57 | 43.11 | 3.71 | 1.692 | 0.146 | 0.075 | 100 | 100 | 0.221 |
| Dolomite Flotation | | | | | | | | | | | | | | |
| 40.4 | 85, 88 | Cell Overflow Dolomite Tail | 44.23 | 1.27 | 1.19 | 0.54 | 40.34 | 7.85 | 1.993 | 0.388 | 0.085 | 32.10 | 85.65 | 0.473 |
| 59.6 | 85, 89 | Cell Underflow Phosphate Conc | 63.41 | 11.75 | 1.45 | 0.59 | 44.98 | 0.90 | 1.550 | 0.031 | 0.070 | 67.90 | 14.35 | 0.101 |
| Sizing at 325M | | | | | | | | | | | | | | |
| 8.1 | 93, 95, 97 | −325M Phos Conc | 63.02 | 7.33 | 1.92 | 0.78 | 45.93 | 1.32 | 1.593 | 0.046 | 0.094 | 9.17 | 2.83 | 0.140 |
| 51.5 | 93, 94 | +325M Phos Conc | 63.47 | 12.45 | 1.38 | 0.56 | 44.83 | 0.83 | 1.543 | 0.029 | 0.067 | 58.73 | 11.52 | 0.096 |
| Silica Flotation | | | | | | | | | | | | | | |
| 45.2 | 98, 99, 101 | Cell Underflow Phosphate Conc | 68.66 | 5.25 | 1.45 | 0.60 | 48.49 | 0.90 | 1.543 | 0.029 | 0.065 | 55.76 | 10.96 | 0.094 |

TABLE II-continued

| % Wt. | Ref. | Fraction | % BPL | % Insol | % $Fe_2O_3$ | % $Al_2O_3$ | % CaO | % MgO | CaO/ $P_2O_5$ | MgO/ $P_2O_5$ | I&A/ $P_2O_5$ | % Distribution BPL | % Distribution MgO | I&A + MgO/$P_2O_5$ |
|---|---|---|---|---|---|---|---|---|---|---|---|---|---|---|
| | | | Processing Material Balance | | | | | | | | | | | |
| 6.3 | 98, 99, 100 | Cell Overflow Silica Tail | 26.26 | 64.12 | 0.86 | 0.29 | 18.58 | 0.33 | 1.550 | 0.029 | 0.096 | 2.97 | 0.56 | 0.124 |
| 53.3 | 97, 101 | Combined −325M Phos Conc Plus Cell Underflow Phos Conc | 67.80 | 5.57 | 1.52 | 0.63 | 48.10 | 0.96 | 1.550 | 0.031 | 0.069 | 64.93 | 13.79 | 0.100 |

The above processing material balance shows a most significant increase in BPL value from 55.66% up to 67.80%. However, the recovery of phosphate values was somewhat less than in Example 1 (53.5% as compared to 73.2%). Since sample 2 pebble initially contained substantially more dolomite (3.71% MgO, as compared to 1.44% MgO), it was necessary that the dolomite flotation remove significantly more of the alkaline earth metal carbonate impurities. The combined steps of first grinding, dolomite flotation, sizing and an amine flotation to remove insolubles (silica) produced a significantly upgraded phosphate concentrate product containing more than 65% BPL, less than 6% insolubles (silica), and less than 1% MgO (as a measure of dolomite). This example shows the improved removal of dolomite made possible by the finer grind (−48 M).

EXAMPLE 3

All the steps of Example 1 were again repeated on another pebble sample of a phosphorite ore from a central Florida ore deposit. After the pebble sample passed through a 35 mesh (Tyler) screen, the ground pebble sample gave the following wet-dry screen analysis.

The ground sample 3 pebble having the wet-dry screen analysis given below was treated as in Example 1, except that the amounts of the reverse flotation reagents were changed. Only 1.5 lbs of carbonate collector (SUL-FON-ATE OA-5) per ton of ground ore and 1.5 lbs of Philflo oil per ton of ground ore were used. The amount of phosphate depressant used remained the same as Example 1.

| Size, Tyler Mesh | Wt., Grams | Wet-Dry Screen Analysis Sample 3 % Wt. | Cum. % Wt. | % BPL | % MgO | % Dist. MgO |
|---|---|---|---|---|---|---|
| +35 | Trace | Trace | Trace | | | |
| −35 + 48 | 25.5 | 9.9 | 9.9 | | | |
| −48 + 65 | 46.5 | 18.1 | 28.0 | | | |
| −65 + 100 | 41.7 | 16.2 | 44.2 | (63.70)* | (1.20)* | 48.9 |
| −100 + 150 | 29.6 | 11.5 | 55.7 | | | |
| −150 + 200 | 23.7 | 9.2 | 64.9 | | | |
| −200 | 90.3 | 35.1 | 100.0 | 59.78 | 2.33 | 51.1 |
| Composite Feed | 257.3 | 100.0 | | | 1.60 | 100.0 |

*Parentheses indicate calculated values.

The processing material balance for sample 3 is set forth in Table III.

As can be seen in Table III, the process is effective in reducing the dolomite impurities below the 1% MgO level even when less carbonate collector and less froth modifier (Philflo oil) is used. The cell underflow concentrate from the dolomite flotation contained 65.19% BPL, and 0.70% MgO. As previously described, the 9.55% Insolubles (silica) can be reduced by conventional silica flotation. The resulting product is completely satisfactory as a feed stock to a chemical plant which makes ammonium phosphate fertilizers.

TABLE III

| % Wt. | Ref. | Fraction | % BPL | % Insol | % $Fe_2O_3$ | % $Al_2O_3$ | % CaO | % MgO | CaO/ $P_2O_5$ | MgO/ $P_2O_5$ | I&A/ $P_2O_5$ | % Distribution BPL | % Distribution MgO | I&A + MgO/$P_2O_5$ |
|---|---|---|---|---|---|---|---|---|---|---|---|---|---|---|
| | | | Processing Material Balance | | | | | | | | | | | |
| 100 | 16, 78, 84 | −3 + 16M Pebble Rodmill −35M | 62.32 | 8.95 | 1.09 | 1.01 | 44.54 | 1.62 | 1.562 | 0.057 | 0.074 | 100 | 100 | 0.131 |
| Dolomite Flotation | | | | | | | | | | | | | | |
| 25.4 | 85, 88 | Cell Overflow Dolomite Tail | 53.90 | 7.17 | 1.34 | 1.45 | 41.88 | 4.34 | 1.698 | 0.176 | 0.113 | 21.97 | 67.77 | 0.289 |
| 74.6 | 85, 89 | Cell Underflow Phosphate Conc | 65.19 | 9.55 | 1.01 | 9.87 | 45.45 | 0.70 | 1.524 | 0.023 | 0.063 | 78.04 | 32.23 | 0.086 |
| Sizing at 325M | | | | | | | | | | | | | | |
| 6.4 | 93, 95, 97 | −325M Phos Conc | 62.54 | 10.11 | 1.57 | 1.69 | 42.31 | 1.07 | 1.478 | 0.037 | 0.114 | 6.42 | 4.47 | 0.151 |
| 68.2 | 93, 94 | +325M Phos Conc | 65.44 | 9.50 | 0.96 | 0.78 | 45.75 | 0.66 | 1.528 | 0.022 | 0.058 | 71.61 | 27.76 | 0.080 |
| Silica Flotation | | | | | | | | | | | | | | |
| | 98, | Cell Underflow | | | | | | | | | | | | |

TABLE III-continued

| % Wt. | Ref. | Fraction | % BPL | % Insol | % $Fe_2O_3$ | % $Al_2O_3$ | % CaO | % MgO | CaO/ $P_2O_5$ | MgO/ $P_2O_5$ | I&A/ $P_2O_5$ | % Distribution BPL | % Distribution MgO | I&A + MgO/ $P_2O_5$ |
|---|---|---|---|---|---|---|---|---|---|---|---|---|---|---|
| | | | Processing Material Balance | | | | | | | | | | | |
| 59.4 | 99, 101 | Phosphate Conc | 71.43 | 1.29 | 1.01 | 0.84 | 49.96 | 0.72 | 1.529 | 0.022 | 0.057 | 68.08 | 26.40 | 0.079 |
| 8.8 | 98, 99, 100 | Cell Overflow Silica Tail | 24.99 | 64.94 | 0.65 | 0.37 | 17.33 | 0.25 | 1.515 | 0.022 | 0.089 | 3.53 | 1.36 | 0.111 |
| 65.8 | 97, 101 | Combined −325M Phos Conc Plus Cell Underflow Phos Conc | 70.56 | 2.16 | 1.06 | 0.93 | 49.22 | 0.76 | 1.524 | 0.024 | 0.062 | 74.50 | 30.87 | 0.086 |

The above Table III shows a substantial upgrading of pebble sample 3 by the combined steps of first grinding the sample, next subjecting it to an anionic flotation employing a sodium salt of sulfonated oleic acid to remove dolomite [Ca,Mg]$CO_3$ as the cell overflow and the major portion of the phosphate values as the cell underflow. Sizing at 325 Mesh (Tyler) in a cyclone produces a −325 M phosphate-rich product (62.54% BPL) and the +325 M phosphate concentrate (65.44% BPL) is reagentized and subjected to an amine flotation to significantly reduce the insolubles (silica) content of the phosphate concentrate (from 9.50% to 1.29%). The sizing at 325 mesh represents an important step, because the −325 M fraction already is very close to acceptable levels of BPL and MgO. When this material is blended with the amine flotation cell underflow, the blended product has completely acceptable levels of BPL and MgO, namely 70.56% BPL and 0.76% MgO. This product was obtained from a pebble which was borderline on phosphate values (62.32% BPL) and not satisfactory on dolomite (measured at 1.62% MgO). The yield of product was 65.8% by weight of the total pebble sample

EXAMPLE 4

Another sample of a phosphorite ore from central Florida was washed, deslimed, and subjected to primary sizing to obtain a −3+16 M pebble. The pebble contained more than 40% BPL but less than 62% BPL (namely about 61.12% BPL). This sample was first subjected to heavy media separation with the results shown in Table IV.

TABLE IV

| % Wt. | Ref. | Fraction | % BPL | % Insol | % MgO | % Distribution BPL | % Distribution MgO |
|---|---|---|---|---|---|---|---|
| | | Processing Material Balance | | | | | |
| Heavy Media Separation | | | | | | | |
| 21.4 | 77 | −3 + 16M Float @ G = 1.85 | 42.30 | 8.39 | 8.04 | 14.8 | 50.3 |
| 78.6 | 78 | −3 + 16M Sink @ G = 1.85 | 66.25 | 5.83 | 2.16 | 85.2 | 49.7 |
| 100.0 | 77, 78 | −3 + 16M Composite | (61.12) | (6.38) | (3.42) | 100.0 | 100.0 |
| Dolomite Flotation | | | | | | | |
| 21.0 | 88 | Cell Overflow Dolomite Tail | 47.25 | 2.92 | 8.17 | 15.0 | 79.6 |
| 79.0 | 89 | Cell Underflow Phosphate Concentrate | 71.31 | 6.61 | 0.56 | 85.0 | 20.4 |

The float product comprised 21.4% of the total solids and contained 42.30% BPL. In this example, the sink product comprised 78.6% of the total solids and contained 66.25% BPL, so it was significantly upgraded by the heavy media separation. However, it still contained an excess of dolomite (measured as 2.16% MgO) and insolubles (5.83% by weight—primarily silica). This sink product was subjected to grinding and dolomite flotation as described in Example 1 and the results are also reported in Table IV. After the sink product had been ground in a rod mill until substantially all of the sample will pass through a 48 Mesh (Tyler) screen, it had the following wet-dry screen analysis.

| Size, Tyler Mesh | Wt., Grams | Wet-Dry Screen Analysis Sample 4 % Wt. | Cum. % Wt. | % BPL | % MgO | % Dist. MgO |
|---|---|---|---|---|---|---|
| + 48 | 1.1 | .5 | .5 | | | |
| −48 + 65 | 35.9 | 17.4 | 17.9 | | | |
| −65 + 100 | 42.5 | 20.6 | 38.5 | (70.06)* | (0.89)* | 26.4 |
| −100 + 150 | 27.1 | 13.1 | 51.6 | | | |
| −150 + 200 | 18.9 | 9.2 | 60.8 | | | |
| −200 | 81.0 | 39.2 | 100.0 | 61.33 | 4.05 | 73.6 |
| Composite Feed | 206.5 | 100.0 | | 66.25 | 2.16 | 100.0 |

*Parentheses indicate calculated values.

The sample 4, −48 M (less than 0.295 mm) fraction was subjected to reverse flotation following the procedure of Example 1 with the following changes: 2 lbs/ton carbonate collector (SUL-FON-ATE OA-5) and 2 lbs/ton froth modifier (white mineral oil) were used. Table IV shows the effectiveness of the dolomite flotation to remove dolomote (measured as MgO) from the phosphorite ore. The dolomite content was 2.16% in the sink product from the heavy media separation, and was decreased down to 0.56% MgO in the phosphate concentrate obtained after grinding and dolomite flotation. The subject phosphate concentrate can optionally be subjected to amine flotation if it is desired to decrease the amount of insolubles below 6.61%.

EXAMPLE 5

This example is like Example 4 above but with a phosphorite ore sample from central Florida which contained considerably less dolomite (measured as 2.10% MgO). As in Example 4, the ore sample was first subjected to primary sizing to obtain a −3+16 M pebble which was then subjected to heavy media separation with the results reported in Table V.

The reverse flotation procedure of Example 1 was again followed to remove dolomite from the −48 M (−0.295 mm) fraction of sample 5 ore which was recovered as the sink product from the heavy media separation. The amounts of the flotation reagents were the same as in Example 1, but the particle size of the ore was finer (−48 M instead of −35 M).

TABLE V

| | | Processing Material Balance | | | | |
|---|---|---|---|---|---|---|
| | | | | | % Distribution | |
| % Wt. | Ref. Fraction | % BPL | % Insol | % MgO | BPL | MgO |
| Heavy Media Separation | | | | | | |
| 14.8 | 77 −3 + 16M Float @ G = 1.85 | 56.70 | 8.69 | 3.55 | 13.3 | 25.2 |
| 85.2 | 78 −3 + 16M Sink @ G = 1.85 | 64.01 | 9.17 | 1.84 | 86.7 | 74.8 |
| 100.0 | 77, −3 + 16M Composite | (62.93) | (9.10) | (2.10) | 100.0 | 100.0 |
| Dolomite Flotation | | | | | | |
| 19.1 | 88 Cell Overflow Dolomite Tail | 51.38 | 4.47 | 6.45 | 15.3 | 66.8 |
| 80.9 | 89 Cell Underflow Phosphate Concentrate | 67.00 | 10.28 | 0.76 | 84.7 | 33.2 |

The sink product of the heavy media separation was ground in a rod mill until substantially all of the material passed through a 48 Mesh (Tyler) screen. The ground product had the following wet-dry screen analysis.

| | | Wet-Dry Screen Analysis Sample 5 | | | | |
|---|---|---|---|---|---|---|
| Size, Tyler Mesh | Wt., Grams | % Wt. | Cum. % Wt. | % BPL | % MgO | % Dist. MgO |
| + 48 | 0.5 | 0.2 | 0.2 | | | |
| −48 + 65 | 29.1 | 14.4 | 14.6 | | | |
| −65 + 100 | 42.0 | 20.8 | 35.4 | (64.70)* | (1.12)* | 35.3 |
| −100 + 150 | 29.2 | 14.4 | 49.8 | | | |
| −150 + 200 | 22.5 | 11.1 | 60.9 | | | |
| −200 | 79.1 | 39.1 | 100.0 | 62.94 | 3.16 | 64.7 |
| Composite Feed | | | | 64.01 | 1.91 | 100.0 |

*Parentheses indicate calculated values.

Table V shows the effectiveness of the dolomite flotation to effectively remove lesser amounts of dolomite (2.10% measured as MgO) from a phosphorite ore by the combined steps of heavy media separation, grinding and dolomite flotation. As seen in Table V, the recovery of phosphate concentrate as cell underflow from the dolomite flotation was 80.9% by weight, and the phosphate concentrate had an acceptably low level of dolomite (less than 1% MgO). The BPL value of 67% is acceptable, and the 10.28% insolubles (silica) can easily be reduced by an amine flotation.

The subject invention makes possible the efficient recovery of phosphate values from lower zone phosphorite ores containing large amounts of alkaline earth metal carbonate impurities such as dolomite [Ca,Mg-]$CO_3$. The upgraded ores are much more suited for use in wet process phosphoric acid production, because the excess dolomite impurities have been removed which would otherwise adversely affect the quality of the acid for use in ammonium phosphate fertilizer production.

When the testing indicates that the ore contains more than about 1% MgO, but less than about 2% MgO and a usable level of phosphate, the reverse flotation method of the subject invention can be used to reduce the MgO (as a measure of dolomite) below 1%. As shown above, it is important that the ore to be subjected to the reverse flotation feed be ground or sized, preferably so that at least 90% by weight passes through a 42 M screen (less than about 0.356 mm particle size).

Grinding of the ore is already necessary in the chemical plant, so it represents a significant economy to insert the dolomite flotation after the grinding step at the chemical plant. The subject method makes possible a substantial increase in usable phosphate recovery from phosphorite ores containing dolomite, or calcite impurities.

Various embodiments of the invention are believed to be within the scope of the following claims.

I claim:

1. A flotation method for separating alkaline earth metal carbonate impurities from a deslimed sized phosphorite ore the steps comprising (a) slurrying with water to about 20–25% solids a phosphorite ore fraction containing phosphate values and an excessive level of alkaline earth metal carbonate impurities, said phosphorite ore fraction having a particle size less than about 0.45 mm;

(b) reagentizing said phosphorite ore fraction by adding thereto a pH regulator to adjust the pH of said slurried phosphorite ore fraction to about 5.5–6.0, a carbonate collector comprising a water soluble salt of a sulfonated linear fatty acid having a straight carbon chain of 12 to 22 carbon atoms, said carbonate collector having a direct carbon to sulfur bond, and a phosphate depressant to depress the phosphate;

(c) subjecting said reagentized, slurried phosphorite ore fraction to flotation;

(d) separating the cell overflow which contains the major amount of said alkaline earth metal carbonate impurities; and (e) collecting the cell underflow phosphate concentrate from said flotation cell which contains the major portion of said phosphate values and a substantially reduced level of alkaline earth metal carbonate impurities.

2. The method of claim 1, in which the alkaline earth metal carbonate impurities comprise dolomite $[Ca,Mg]CO_3$.

3. The method of claim 2, in which the carbonate collector comprises sodium oleyl sulfonate.

4. The method of claim 3, in which the carbonate collector is added to the slurried fraction at the rate of about 1.5 to 2.75 pounds/ton of said solids in said slurried fraction.

5. The method of claim 2, in which the carbonate collector comprises a water soluble salt of a sulfonated linear fatty acid having the structural formula

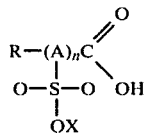

R = substituted or unsubstituted alkyl or alkenyl having a straight chain of one to twelve carbon atoms;
A = substituted or unsubstituted alkyl or alkenyl;
n = 5 to 17;
X = Na, K, Li, $NH_3$.

6. The method of claim 5, in which the phosphate depressant comprises sodium tripolyphosphate.

7. The method of claim 2, in which the phosphate depressant is selected from the group consisting of sodium tripolyphosphate, sodium hexametaphosphate, sodium pyrophosphate, fluosilicic acid and orthophosphoric acid.

8. The method of claim 1, in which the phosphate ore comprises a Western phosphate ore containing calcium carbonate as the alkaline earth metal carbonate impurity.

9. The method of claim 8, in which the carbonate collector is sodium oleyl sulfonate.

10. The method of claim 1, including the further step of subjecting the cell underflow phosphate concentrate containing the major portion of phosphate values to an amine float to remove silica impurities and further upgrade the phosphate content of the resulting phosphate concentrate which is collected as the amine float cell underflow.

11. A process for beneficiating a phosphate ore flotation feed by a reverse flotation process, said feed being obtained from a phosphorite ore having a particle size range in which at least 90% by weight of the particles are less than about 0.45 mm said phosphorite ore including discrete particles of francolite containing a major portion of the phosphate values in said phosphorite ore, said ore also including discrete particles of an alkaline earth metal carbonate mineral impurity, the steps of said process comprising:

(a) first preparing a reagentized phosphate ore flotation feed by adjusting the solids level of the phosphorite ore with water to a solids level of 20–30%; adding a pH regulator as necessary to adjust the pH to a range from about 4.5–7.0; adding a francolite depressant to said phosphorite ore at the rate of about 0.2 to 5 lbs/ton of solids, said depressant being selected from the group consisting of sodium tripolyphosphate, sodium hexametaphosphate, sodium pyrophosphate, fluosilicic acid and orthophosphoric acid; adding a carbonate collector anionic reagent to said phosphorite ore in an amount from about 0.2 to about 5.0 lb/ton of phosphorite ore solids, said carbonate collector being selected from the group consisting of the alkali metal salts of sulfonated linear fatty acids having a straight carbon chain from about eight to twenty-two carbons, and a direct carbon to sulfur bond, thereby forming a reagentized phosphate ore flotation feed;

(b) subjecting the reagentized phosphate ore flotation feed to a reverse flotation wherein a major portion of the alkaline earth metal carbonate impurities are floated away as the flotation cell overflow and a major portion of the francolite from the phosphate ore flotation feed is recovered as the flotation cell underflow.

12. The method of claim 11, in which the carbonate collector is the sodium salt of sulfonated oleic acid.

13. The method of claim 11, in which the carbonate collector is an alkali metal salt of a sulfonated fatty acid selected from the group consisting of oleic, lauroleic, myristoleic, palmitoleic, erucic, linoleic, linolenic, stearic, elostearic, elaidic, and palmitic acids, and optical isomers thereof.

14. The method of claim 13, in which the linear fatty acid includes unsaturated carbon to carbon bonds.

15. The method of claim 13, including the additional step of subjecting the flotation cell underflow containing the major portion of francolite to an amine float to remove silica impurities and further increase the phosphate content of the resulting amine float cell underflow rich in francolite.

16. The method of claim 11, in which the carbonate collector is a water soluble sodium salt of sulfonated linear fatty acid having the general structural formula

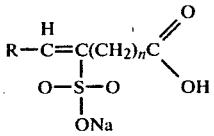

R = $CH_3[CH_2]_7$;
n = 5–8.

17. The method of claim 11, in which the carbonate collector is sodium oleyl sulfonate and the francolite depressant is sodium tripolyphosphate.

18. The method of claim 11, in which the pH of the flotation feed is maintained at about 5.5–6.0 and the carbonate collector is supplied at the rate of about 2 lbs/ton of flotation feed solids, and an extender for said carbonate collector is added to said flotation feed, said extender comprising a hydrocarbon selected from the group consisting of dewaxed oil, kerosene, mineral oil, diesel oil, #5 fuel oil and combinations of these.

19. The method of claim 18, in which the francolite depressant is supplied at the rate of about 2 lbs/ton of flotation feed.

20. The method of claim 19, in which the alkaline earth metal carbonate impurity comprises dolomite $[Ca,Mg]CO_3$ and the flotation feed cell underflow contains less than 1% by weight MgO as a measure of dolomite.

21. The method of claim 11, in which the alkaline earth metal carbonate impurity comprises dolomite $[Ca,Mg]CO_3$ and the phosphate ore flotation feed is selected from a phosphate ore fraction containing more than 1% MgO as a measure of dolomite, and which has been previously subjected to one or more of the following: a skin flotation, a coarse float, a fine float, an amine float, a heavy media separation and combinations of these.

22. The method of claim 11, including the additional steps of:

(c) subjecting the flotation cell underflow containing the major portion of francolite to cyclone separation to obtain a +325M fraction;

(d) acid scrubbing the +325M fraction;

(e) adjusting the solids level of the +325M fraction to 68–72% solids;

(f) washing said +325M fraction and reagentizing said +325M fraction with amine, kerosene and pH reagents;

(g) subjecting said reagentized +325M fraction to an amine float to remove silica tail as the flotation cell overflow, and collect an underflow fraction rich in francolite, and having a substantially reduced silica content.

23. A reverse flotation method for removing alkaline earth metal carbonate impurities, particularly dolomite $[Ca,Mg]CO_3$ and calcite $CaCO_3$ from a phosphate concentrate obtained from phosphorite/dolomite ores, includings the steps of (a) reagentizing the phosphate concentrate with a phosphate depressant, a carbonate collector and a pH regulator to pH 5.5–6.5, and adjusting the solids to about 20–30% with water to make a flotation feed; and (b) subjecting the flotation feed to flotation to cause less dense alkaline earth metal carbonate mineral impurities to float, and the phosphate-containing materials to sink to thereby remove said alkaline earth carbonate mineral impurities as an overflow tail to waste, and to collect as an underflow a phosphate concentrate containing substantially less alkaline earth metal carbonate impurities, said carbonate collector being selected from the group consisting essentially of the alkali metal salts of sulfonated fatty acids having a linear carbon chain of 8–22 carbon atoms and in which the sulfur moiety is attached directly to a carbon atom in the fatty acid linear chain.

* * * * *

UNITED STATES PATENT AND TRADEMARK OFFICE

CERTIFICATE OF CORRECTION

PATENT NO. : 4,364,824

DATED : December 21, 1982

INVENTOR(S) : Robert E. Snow

It is certified that error appears in the above-identified patent and that said Letters Patent are hereby corrected as shown below:

Column 3, line 2, "phoshorite" should read -- phosphorite --

Column 5, line 30, "flotatiion" should read -- flotation --

Column 9, in the table, line 55, the column heading "Cum. Wt." should read -- Cum. % Wt. --

Column 17, line 4, "dolomote" should read -- dolomite --

Column 17, Table V, line 3 under heading "Heavy Media Separation" the reference numeral "77" should read -- 77, --
78

Signed and Sealed this

Sixteenth Day of August 1983

[SEAL]

Attest:

GERALD J. MOSSINGHOFF

Attesting Officer

Commissioner of Patents and Trademarks